US006234894B1

(12) United States Patent
Goracke et al.

(10) Patent No.: US 6,234,894 B1
(45) Date of Patent: May 22, 2001

(54) FORCED AIR VENT REGISTER

(76) Inventors: Mark A. Goracke, 245 Redwood Hwy., Grants Pass, OR (US) 97527; Stephen B. Albert, 3135 Canal St., Grants Pass, OR (US) 97526

( * ) Notice: Subject to any disclaimer, the term of this patent is extended or adjusted under 35 U.S.C. 154(b) by 0 days.

(21) Appl. No.: 09/524,195

(22) Filed: Mar. 13, 2000

(51) Int. Cl.[7] ..... F24F 13/08
(52) U.S. Cl. ..... 454/290; 454/324; 454/332
(58) Field of Search ..... 454/289, 290, 454/309, 324, 330, 331, 332, 334

(56) References Cited

U.S. PATENT DOCUMENTS

| | | | | |
|---|---|---|---|---|
| 124,663 | * | 3/1872 | Bunce et al. | 454/331 |
| D. 284,996 | | 8/1986 | Bergdahl . | |
| D. 338,060 | | 8/1993 | Solie . | |
| D. 362,059 | | 9/1995 | Wojcik . | |
| 703,409 | * | 7/1902 | Hart | 454/331 |
| 1,911,851 | * | 5/1933 | Sholtz | 454/289 |
| 2,104,208 | * | 1/1938 | Oltrogge | 454/331 |
| 2,216,420 | | 10/1940 | Rose . | |
| 2,587,633 | * | 3/1952 | Levin | 454/289 |
| 3,528,359 | * | 9/1970 | Sand | 454/324 |
| 3,559,560 | | 2/1971 | Trahan . | |
| 3,589,265 | | 6/1971 | Hedrick | 454/289 |
| 5,163,871 | | 11/1992 | Huibregtse et al. | 454/289 |
| 5,275,405 | | 1/1994 | Ridge . | |
| 5,551,915 | * | 9/1996 | Schweikert | 454/290 |
| 5,720,660 | | 2/1998 | Benedetto et al. . | |
| 5,792,230 | | 8/1998 | Moore et al. . | |
| 5,928,078 | | 7/1999 | Moore et al. . | |
| 6,019,677 | * | 2/2000 | Demster | 454/290 |

FOREIGN PATENT DOCUMENTS

| | | | | |
|---|---|---|---|---|
| 889058 | * | 12/1971 | (CA) | 454/324 |

* cited by examiner

*Primary Examiner*—Harold Joyce
(74) *Attorney, Agent, or Firm*—Dellett and Walters

(57) ABSTRACT

A forced air vent register that is adapted to house pieces of flooring identical to the surrounding flooring. The register is of sufficient structural strength to withstand distortion under considerable forces.

18 Claims, 8 Drawing Sheets

FORCED AIR VENT REGISTER

BACKGROUND OF THE INVENTION

This invention relates to ventilation heating and cooling and more particularly to a forced air vent register that can be made to match the surrounding environment.

The normal practice when installing ceramic floor tile is to lay the tile up to the edges of the register opening and then to install a conventional metal register over or in the opening such that the flange of the register overlaps the ceramic tile about the periphery of the register opening and transitions or "dresses" the tiled floor into the register opening. The process is similar whether the flooring material is wood, carpeting, ceramic tile, linoleum, laminate, or stone such as granite, marble or slate.

In upscale residential or commercial buildings, flooring commonly uses expensive hardwoods or tile such as ceramic, slate, marble, granite, laminate, etc. Coordinating the forced air vent registers or grilles to the flooring is desirable but difficult because of the limited styles of registers. Fabrication of matching wood grilles is possible because of wood's structural characteristics but because of the open space required for air passage, wooden registers have limited strength. Although wooden grilles are available at a premium price, they are only readily available in domestic woods such as oak, which will not coordinate with the flooring if the flooring is of an exotic wood or has contrasting colored accents in the area of the register opening. This mismatch between the floor covering and the registers detracts from the area's aesthetic appeal. Additionally, wooden constructed registers are usually "fixed" and do not have the capability to adjust the air flow through the register.

Fabrication of a grill solely from ceramic tile is impractical because the brittle nature of ceramic tile will not accommodate the application of unsupported weight. Hiding or disguising registers in a ceramic tile floor is often impossible as the available registers are of painted or plated steel construction and stand out from the flooring material.

Another problem with existing registers is that they tend to sit slightly above the flooring which emphasizes the visual obtrusiveness of the register. These registers also function as a lip on which to stub toes or damage footwear.

Fabrication of matching registers for each separate type of flooring in all the applicable sizes would be impractical and would result in prohibitively expensive registers.

SUMMARY OF THE INVENTION

In accordance with the invention, an improved air vent register is provided which is adapted to sit flush with the surrounding flooring and to allow flooring pieces to be installed into the grille thereby making a perfect match for the floor.

Accordingly, it is an object of the present invention to provide an improved forced air vent register that can withstand the application of considerable unsupported weight without deformation or structural damage.

It is a further object of the present invention to provide an improved forced air vent register that can house sections of flooring so as to visually appear to be a continuation of the floor.

It is yet another object of the present invention to provide an improved forced air vent register that resides flush with the top surface of the existing floor and which allows for a full range of air flow adjustments.

It is still a further object of the present invention to provide an improved forced air vent register that is easily removed for cleaning and retrieval of objects.

It is yet a further object of the present invention to provide an improved forced air vent register that houses and supports cut pieces of tile, stone, hardwood and laminate floor covering thus coordinating the register to the surrounding floor covering.

It is yet still a further object of the present invention to provide an improved forced air vent register that houses and supports cut pieces of flooring, resides flush with the top surface of the existing floor and has a mechanism capable of adjusting the air flow through the register.

The subject matter of the present invention is particularly pointed out and distinctly claimed in the concluding portion of this specification. However, both the organization and method of operation, together with further advantages and objects thereof, may best be understood by reference to the following description taken in connection with accompanying drawings wherein like reference characters refer to like elements.

DETAILED DESCRIPTION

The apparatus according to a preferred embodiment of the present invention comprises a forced air vent register and more specifically a substrate or backbone of a register that is adapted to receive matching inserts of the surrounding flooring.

Figure 1:
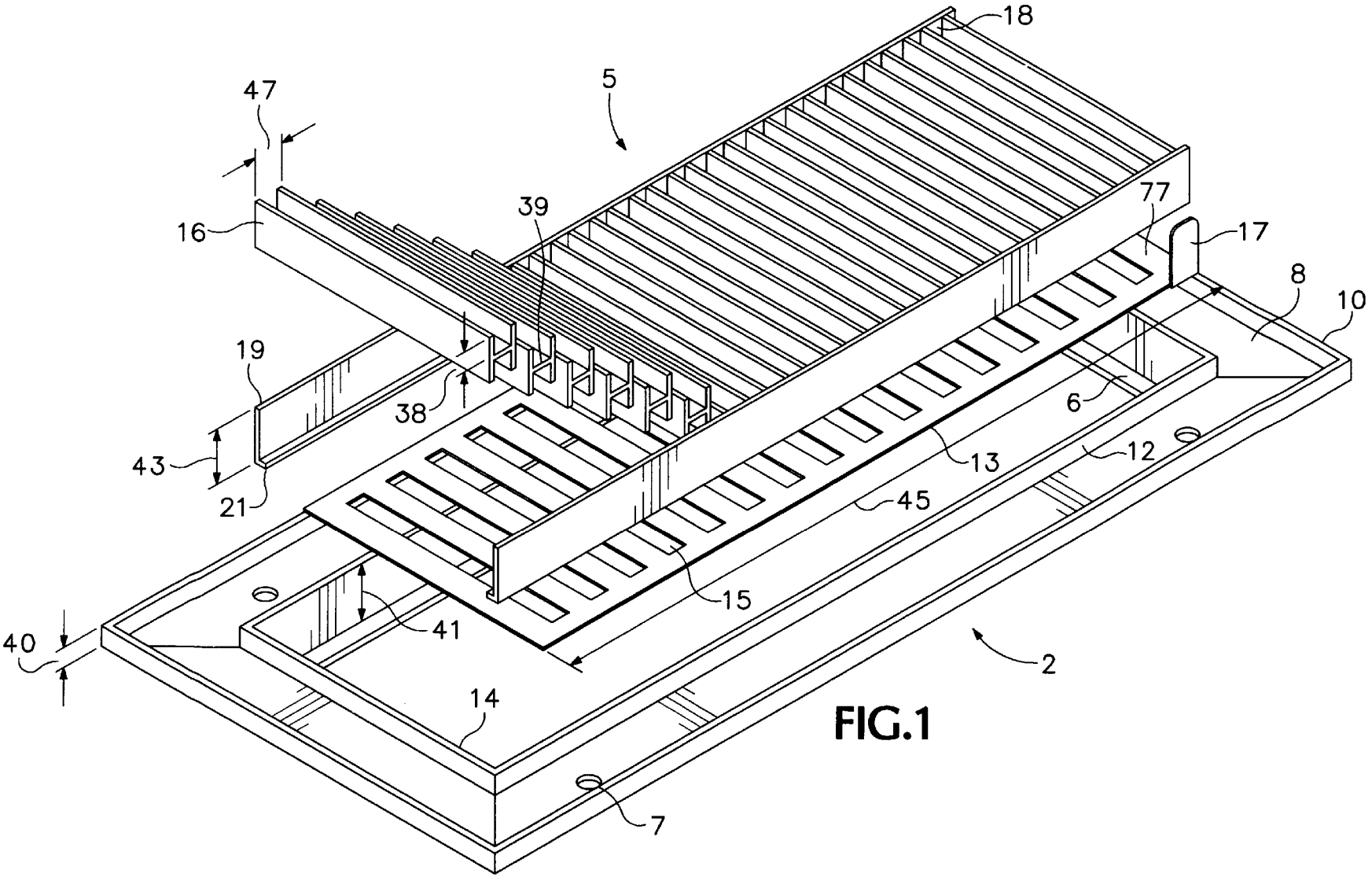
FIG. 1 is a perspective view of the preferred embodiment of the forced air vent register in disassembled, partially exploded form.

FIG. 1, a perspective view of the forced air vent register when disassembled according to the present invention, illustrates the following three components that make up the preferred embodiment: border support 2; air flow adjustment plate 13; and louver cradle assembly 5. A portion of the FIG. 1 view is exploded to further illustrate components of the register.

A rectangular border support 2 is formed from U-shaped channels with bottom 8, exterior side walls 10 and interior side walls 12, the interior side walls defining a border opening 14. A flange 6 projects normally from the bottom of the interior side walls. The bottom of the border support has beveled holes 7 defined therein to accept screws or nails, allowing for the countersinking of tapered heads on the screws or nails.

Air flow adjustment plate 13 is suitably a thin rectangular plate with plural slit openings 15. An adjustment tab 17 is affixed to the plate so as to project upwardly and perpendicularly from the top face 77 of the plate. The bottom face of the plate (not illustrated) rests on flange 6. The length of the plate as illustrated by dimension arrow 45 is shorter than the length of the corresponding dimension of border opening 14.

Removable louver cradle assembly 5 is formed of plural channels 16 and parallel beams 19. A web 39 resides in each channel so as to provide support for a piece of flooring, giving each channel an H-shape. Channels 16 rest on lips 21 of beams 19 and are positionally spaced and affixed to the beams by welding or any other suitable mechanical attachment method such that the longitudinal axis of adjacent channels 16 are parallel. The spacing of the channels 16 is such as to define equal louver spaces 18 between any two adjacent channels. The louver cradle rests on the top face of the plate.

The border support height as indicated by dimension arrow 40 is approximately equal to the depth defined between the top of H-shaped channel 16 and the floor of web 39 as indicated by dimension arrow 38, allowing for the accommodation of identical thickness flooring materials in the border support and the louver cradle channels. The height of interior side walls 12 as indicated by dimension arrow 41 is approximately equal to the combined thickness of plate 13 and the height of beam 19 as indicated by dimension arrow 43. This allows for the top surfaces of identical flooring material installed in the border support and the louver cradle channels to be flush when the louver cradle and air adjustment plate are installed in the border support.

Figure 2:
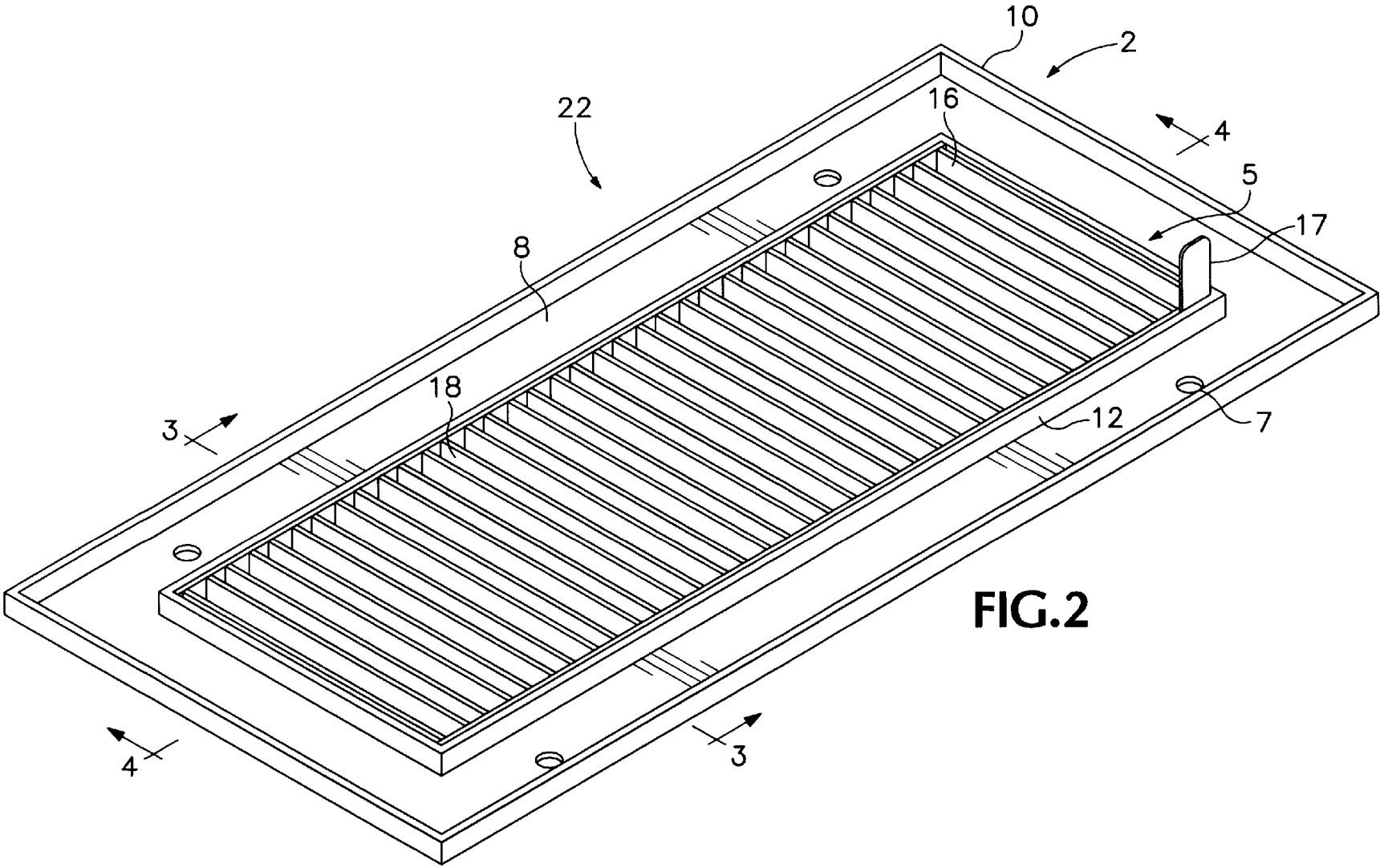
FIG. 2 is a perspective view of the preferred embodiment of the forced air vent register shown assembled.

FIG. 2, a perspective view of the preferred embodiment of the forced air vent register when assembled, shows air adjustment plate 13 and louver cradle 5 placed within opening 14 (FIG. 1) of border support 2. Tab 17 fits between beam 19 and interior side wall 12, thus projecting from the top face of the register.

Referring to FIG. 1 and FIG. 2 together, it can be seen that register 22 is assembled by stacking louver cradle 5 onto air adjustment plate 13 which in turn stacks on top of border support 2. Bottom lips 21 defined on beams 19 of the louver cradle rest on the top face 77 of the air flow adjustment plate, while the bottom face of the air flow adjustment plate rests on flange 6 of the border support. In this configuration the top surfaces of louver cradle 5 are suitably maintained flush with the top surfaces of border support 2. Note that the flanges 6 do not need to be provided on all four of the interior sides of the border support, and are only necessary on any pair of opposite interior sides. The preferred sides for the flanges are the interior sides parallel with the beams. The length of air flow adjustment plate 45 is less than the corresponding dimension of border opening 14 thereby allowing limited sliding movement of plate 13 along the direction of the longitudinal axis of the register. Slit openings 15 approximate the size of louver spaces 18 wherein both are slightly smaller than the H-shaped channel thickness 47. Applying pressure on tab 17 in the direction of the longitudinal axis of plate 13 moves the plate within border opening 14. This movement adjustably positions the slits anywhere between complete vertical alignment below the louver spaces and complete vertical alignment below the H-shaped channels, allowing for 0 to 100% adjustment of the air flow through the register.

Figure 3:
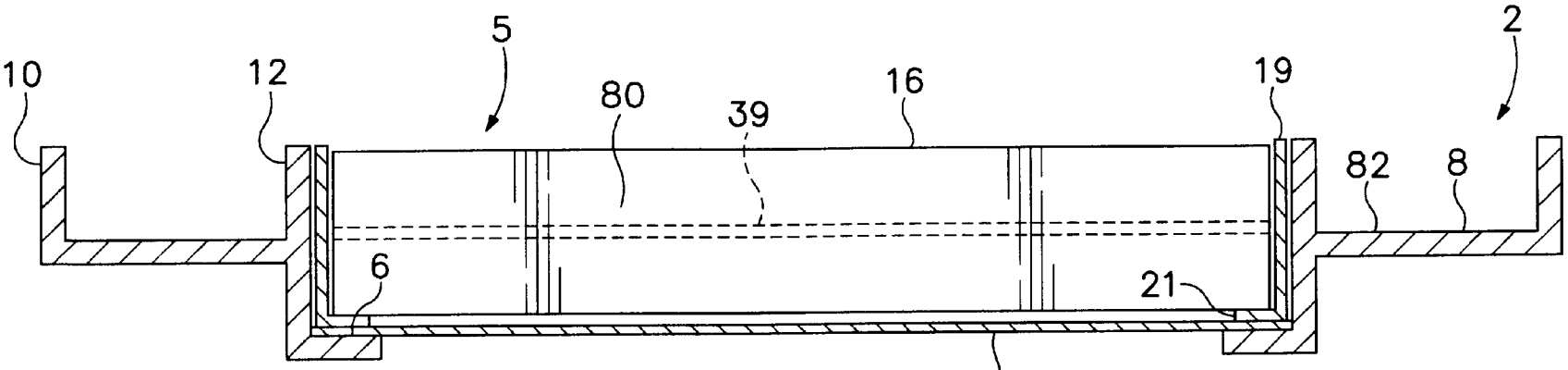
FIG. 3 is an enlarged cross sectional view of the preferred embodiment of the forced air vent register taken through line 3—3 of FIG. 2.

FIG. 3, an enlarged cross sectional view of the preferred embodiment of the forced air vent register taken through line 3—3 of FIG. 2, illustrates the supporting relationship between the air adjustment plate 13 and lips 21 of beam. The location of channel web 39 is illustrated in phantom. Web top face 80 is approximately horizontally aligned with top face 82 of the border support bottom.

Figure 4:
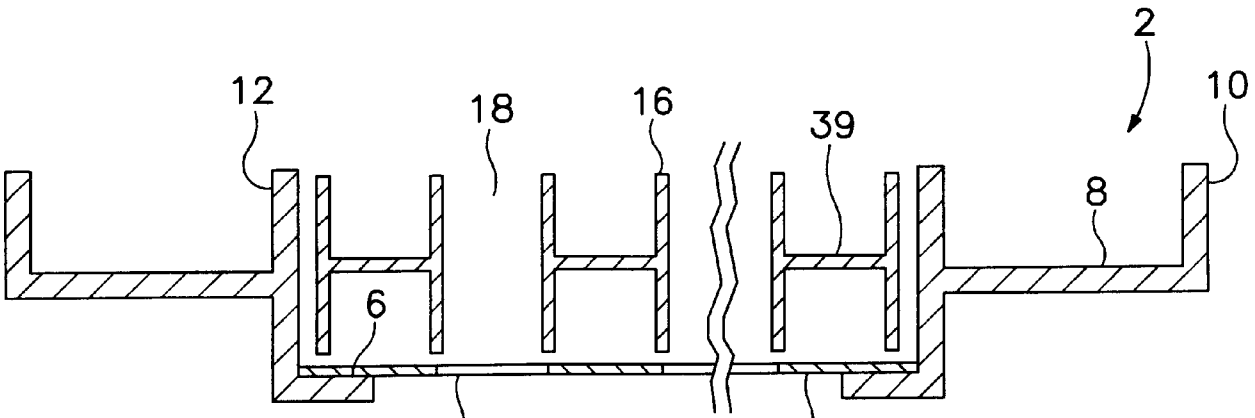
FIG. 4 is an enlarged cross sectional view of the preferred embodiment of the forced air vent register taken through line 4—4 of FIG. 2.

FIG. 4, an enlarged cross sectional view of the preferred embodiment of the forced air vent register taken through line 4—4 of FIG. 2, shows the spaced relationship between adjacent channels 16. Louver spaces 18 are substantially equal between the channels. Note, that air adjustment plate 13 does not extend the entire distance between interior side walls 12.

Figure 5:
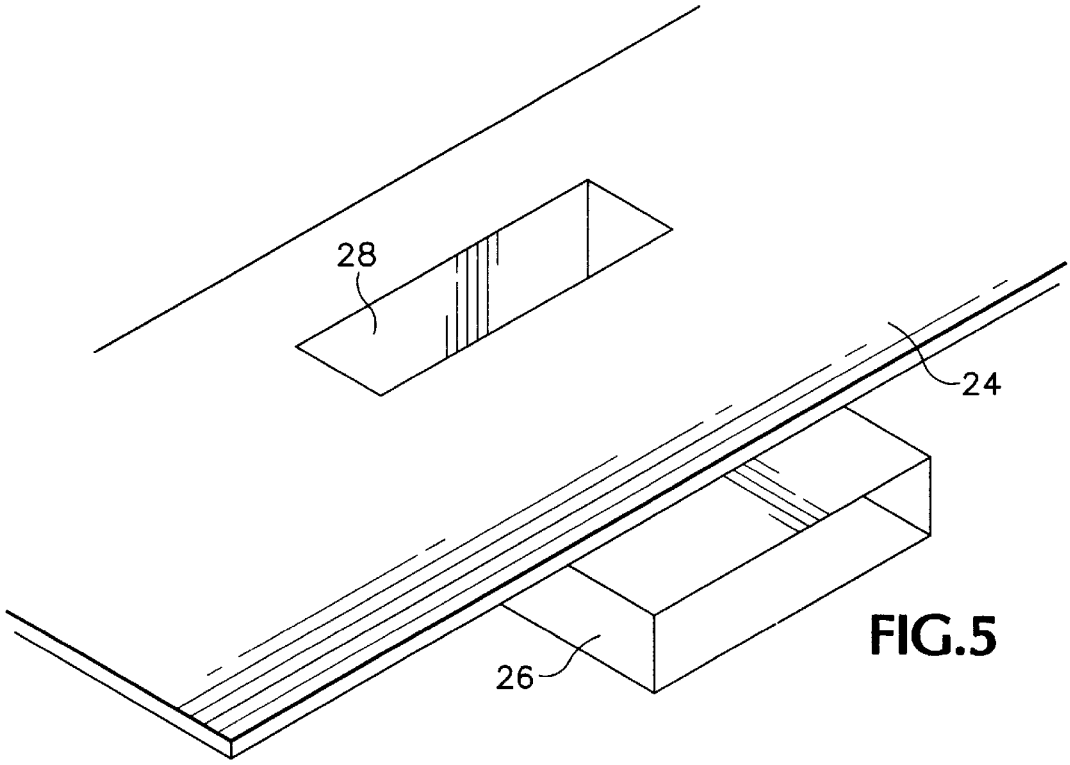
FIG. 5 is a diagrammatic perspective view of a subfloor housing a forced air vent.

FIG. 5, a diagrammatic perspective view of a subfloor housing a forced air vent, illustrates a subfloor 24 with a cutout portion forming a vent opening 28 for the purpose of accommodating a forced air vent 26 to allow the flow of air between the air mover and the room.

Figure 6:
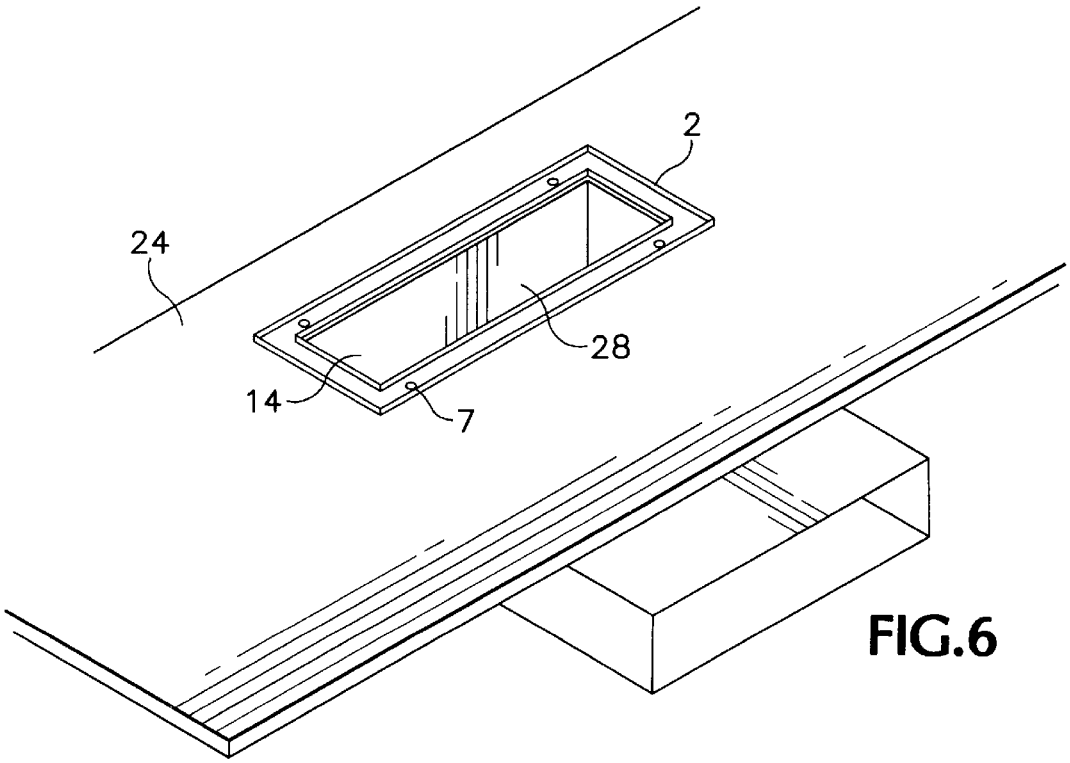
FIG. 6 is a diagrammatic perspective view of the border support of the preferred embodiment of the forced air vent register installed around a forced air vent opening.

FIG. 6, a diagrammatic perspective view of the border support of the preferred embodiment of the forced air vent register installed around a forced air vent opening, illustrates border support 2 affixed to subfloor 24 by nails or screws through beveled holes 7. Border support 2 is manually positioned so as to allow vertical alignment between border opening 14 and vent opening 28. Flange 6 of the border support has slightly smaller peripheral dimensions than the width and length of border opening 14 so that border support 2 actually protrudes minimally into the border opening. This ensures that the raw edges of the subfloor are concealed and that the register fits into the border opening with room for adjustment to obtain aesthetic alignment with the surrounding flooring.

Figure 7:
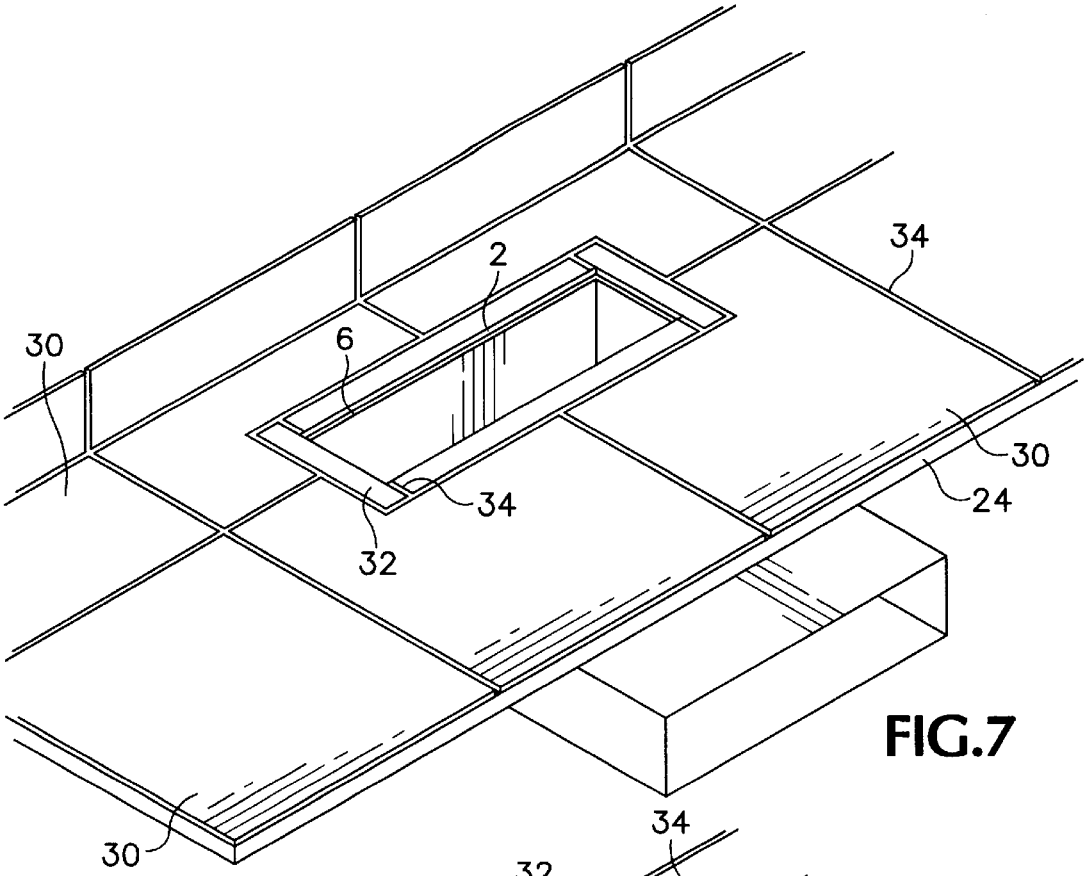
FIG. 7 is a diagrammatic perspective view of a tiled subfloor and a border support with tile pieces installed.

FIG. 7, a perspective view of a tiled subfloor and border support, shows ceramic tiles 30 glued to subfloor 24 with grout 34 between adjacent tiles. Tile pieces 32 are affixed within channels 16 of border support 2. Grout 34 fills the remaining space between tile pieces within border support 2 that reside perpendicular to each other 34.

Figure 8:
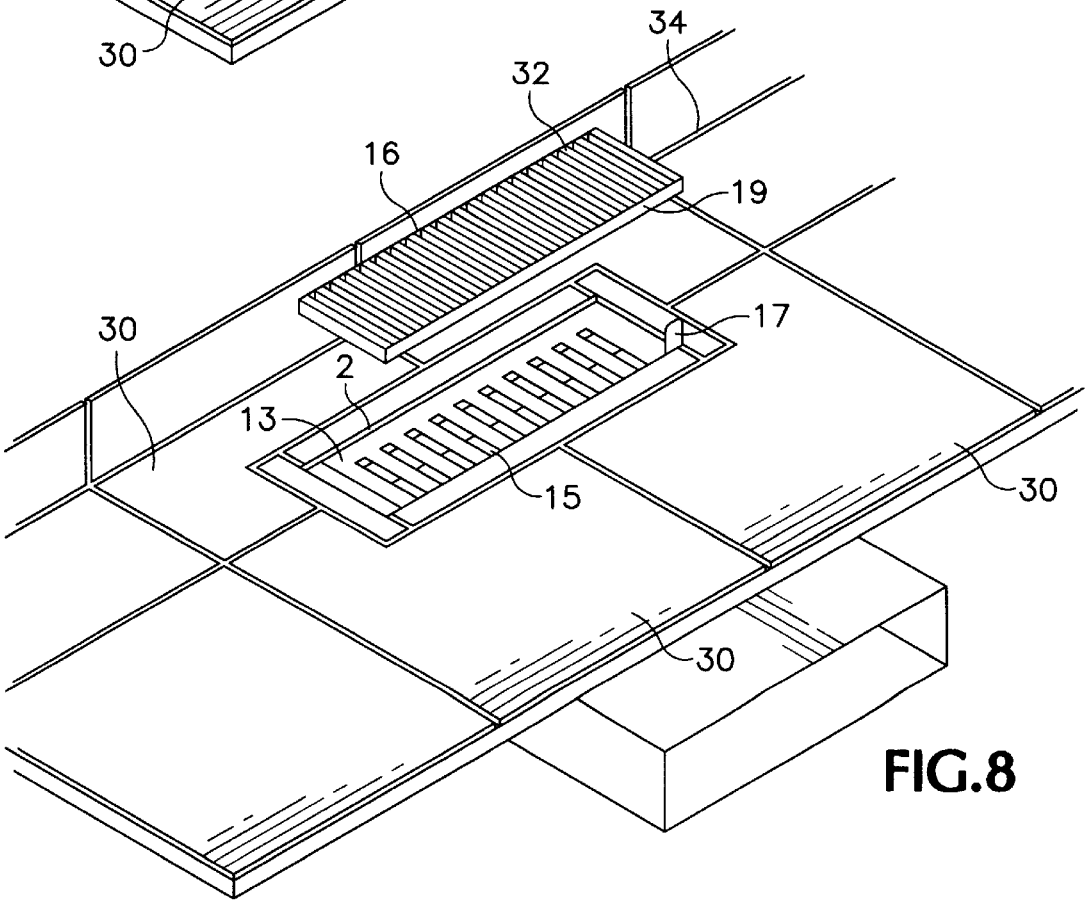
FIG. 8 is an exploded diagrammatic perspective view of a tiled subfloor, a tiled installed border support with a air adjustment plate installed and a tiled louver cradle.

FIG. 8, an exploded view of a subfloor, a border support and a louver cradle, shows ceramic tile pieces 32 installed within H-shaped channels 16. Plate 13 has been installed into border opening 14 and rests on flange 6.

Figure 9:
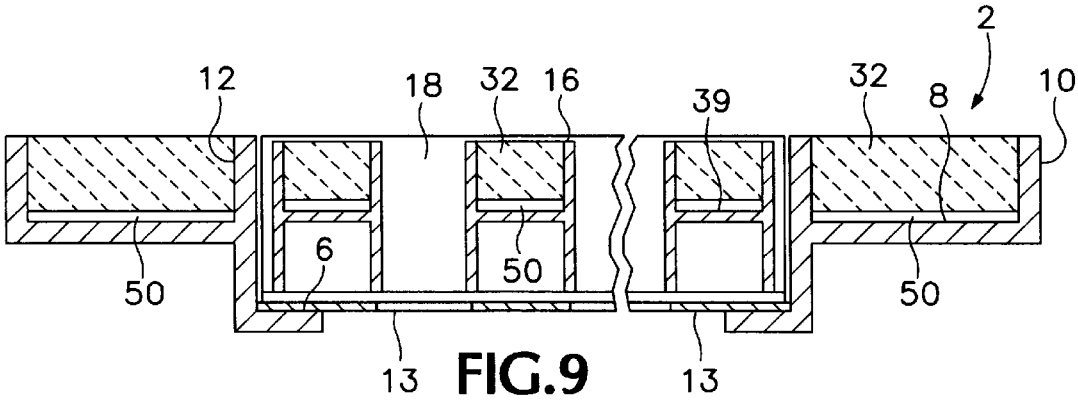
FIG. 9 is an enlarged cross sectional view of the preferred embodiment of the forced air vent register as in FIG. 4 with tile installed.

Referring to FIG. 9, an enlarged cross sectional view of the preferred embodiment of the forced air vent register, ceramic tile pieces 32 are affixed to border support bottom 8 and web 39 by a suitable adhesive 50.

Figure 10:
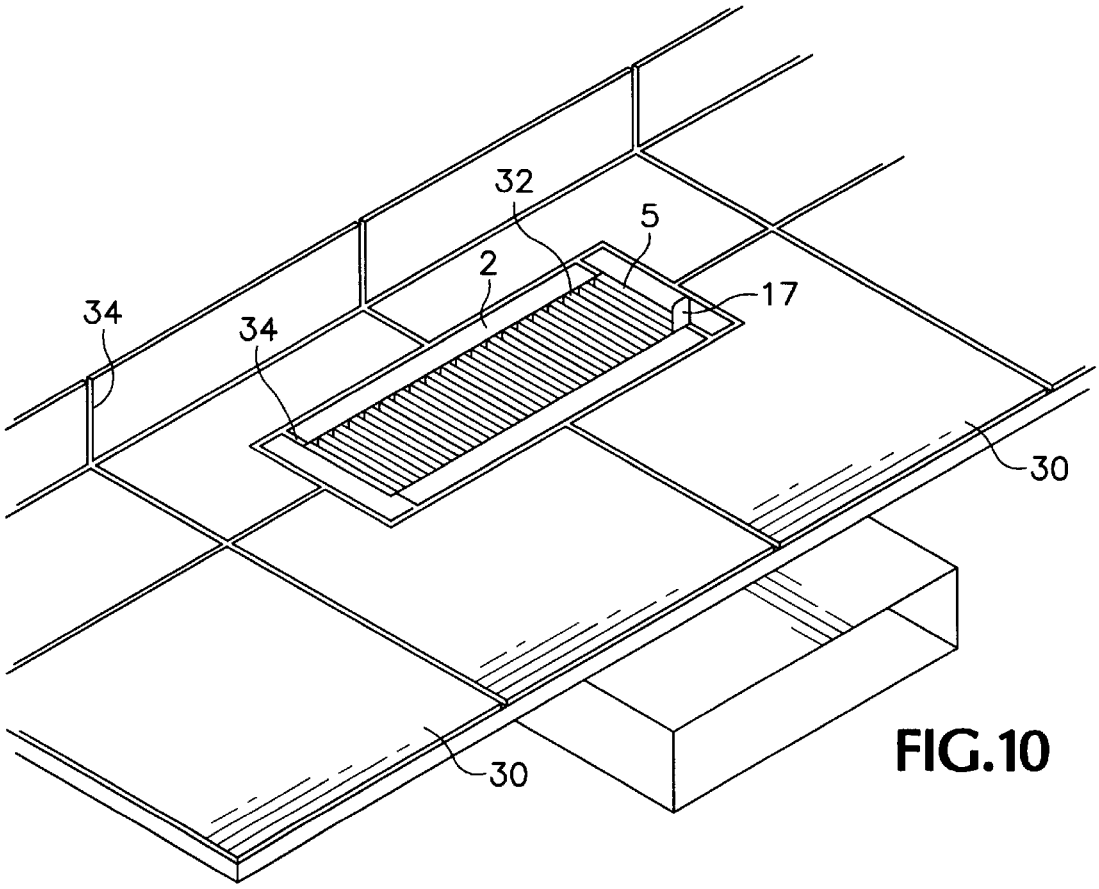
FIG. 10 is a perspective view of a tiled floor with the preferred embodiment of the forced air vent register installed.

Referring to FIG. 10, a perspective view of a tiled floor with the preferred embodiment of the forced air vent register installed, illustrates louver cradle 5 positioned into the border opening 14 of border support 2. Ceramic tile pieces 32 have been installed into channels 16 and into border support 2. Tab 17 projects above and perpendicular to the surrounding floor.

The finished appearance of a preferred or alternate embodiment forced air vent register, is shown in FIG. 10.

Referring to FIGS. 5–10, it can be seen that subfloor 24 has a cutout region forming vent opening 28 that is sized to accommodate forced air vent 26. In use, border support 2 is affixed to subfloor 24 by nails or screws inserted through holes 7 or a suitable adhesive such that border support opening 14 is manually aligned with vent opening 28. Note that it is not necessary for the border support to be affixed to the floor as its weight and the neighboring flooring will maintain its location. In this position flange 6 overhangs the edge of vent opening 28 and projects toward the center of vent opening 14. The dimensions of border opening 14 are substantially similar to the dimensions of vent opening 28, maximizing the air flow through register 22 and minimizing air resistance.

Once border support 2 is installed, pieces of tile 32 or flooring material are cut to fit into border support 2 and are adhesively affixed to border support bottom 8 with suitable adhesive 50. The placement of the tile pieces within border support 2 may incorporate spaces between adjacent tiles for grout depending upon the size of the tiles used, the size of the register and the pattern of the tile installation. Typically the process of installing tiles 30 onto subfloor 24 will also be performed at this time. Similarly, pieces of tile 32 or flooring material are cut to fit into the grooves formed by each H-shaped channel 16 of louver cradle 5 and are adhesively affixed to channel webs 39 as shown in FIG. 9.

Figure 11:
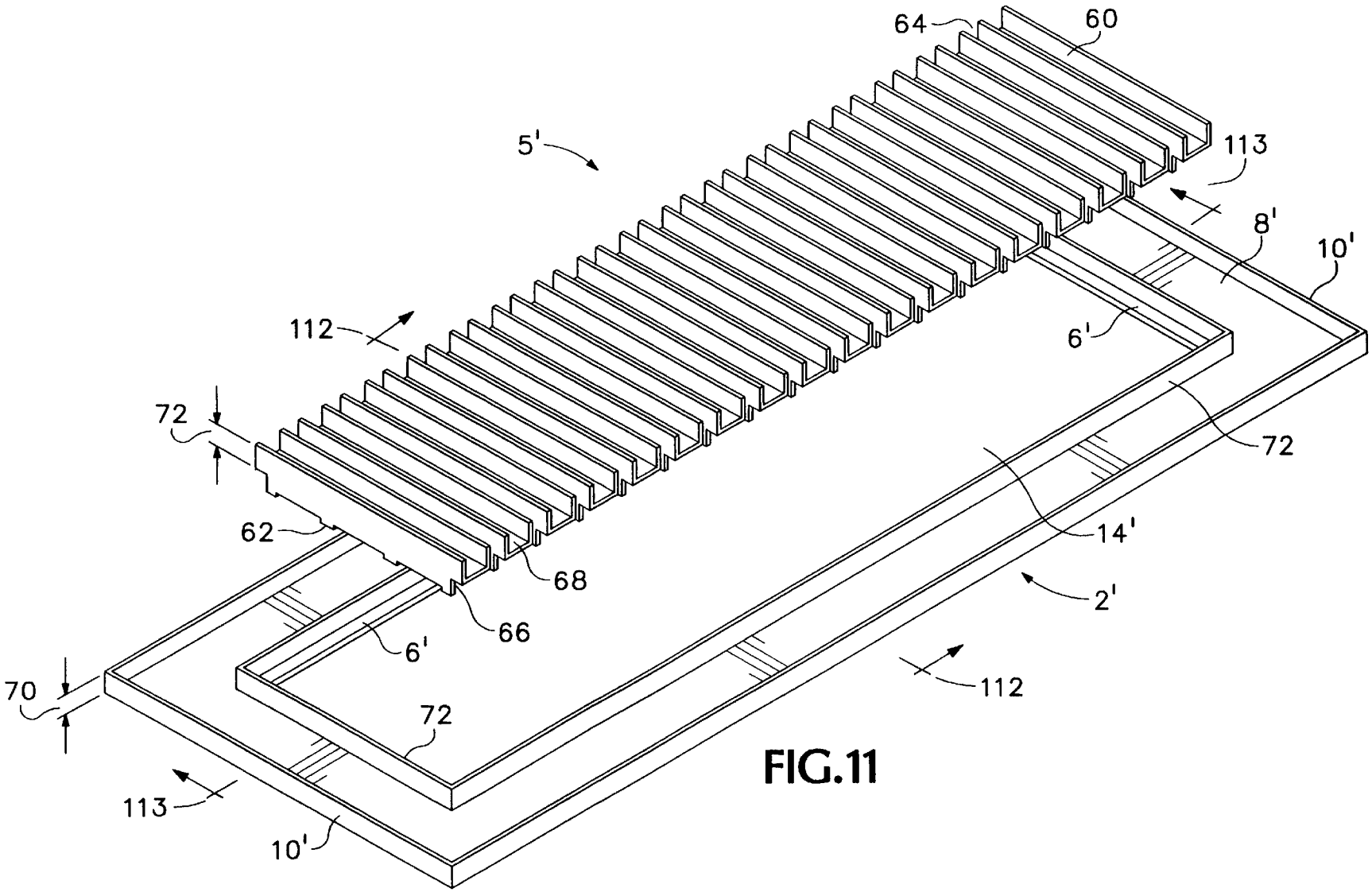
FIG. 11 is a perspective view of an alternate embodiment of the forced air vent register in disassembled form.

Referring to FIG. 11, a perspective view of an alternate embodiment of the forced air vent register according to the present invention, shown disassembled, illustrates a different design for a louver cradle 5' and border support 2'. Here the removable louver cradle 5' is formed of plural U-shaped channels 60 held equidistantly apart by channel supports 62 such that the longitudinal axis of adjacent channels are parallel. Adjacent to each channel are identical louver spaces 64. Channels 60 have notches 66 at either end that protrude beyond channel bottoms 68. Border support 2' is approximately identical to border support 2 except interior side wall 12 of border support 2 is deeper than interior side 72 of border support 2' because the depth of H-shaped channel 16 is approximately twice the depth of U-shaped channel 60. Thus cradle flange 6', bottom 8', exterior side walls 10' and interior border opening 14' are identical to their counterparts cradle flange 6, bottom 8, exterior side walls 10 and interior border opening 14. This alternative embodiment does not employ an air adjustment plate, although one can be provided, if desired, in a manner corresponding to that of the preferred embodiment.

Figure 12:
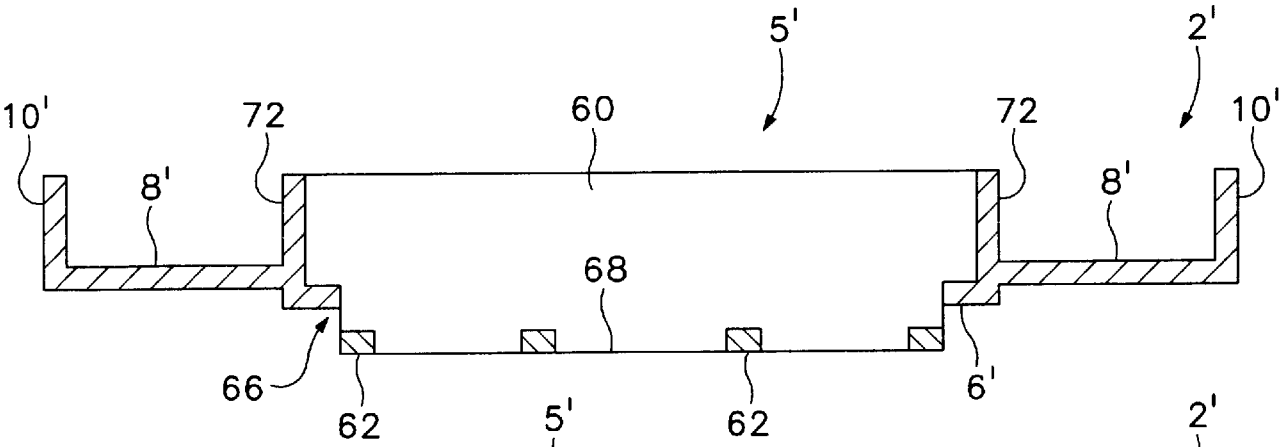
FIG. 12 is an enlarged cross sectional view of the assembled alternate embodiment of the forced air vent register along line 112—112 of FIG. 11.

Referring to FIG. 12, an enlarged cross sectional view of the assembled alternate embodiment of the forced air vent register taken in the direction of line A—A of FIG. 11, the notches 66 of U-shaped channels 60 rest on flange 6' of border support 2' thereby supporting the louver cradle 5'. Channel supports 62 are affixed to the bottom of channels 60 so as to reside perpendicular to the longitudinal axis of the channels and form the louver cradle 5'.

Figure 13:
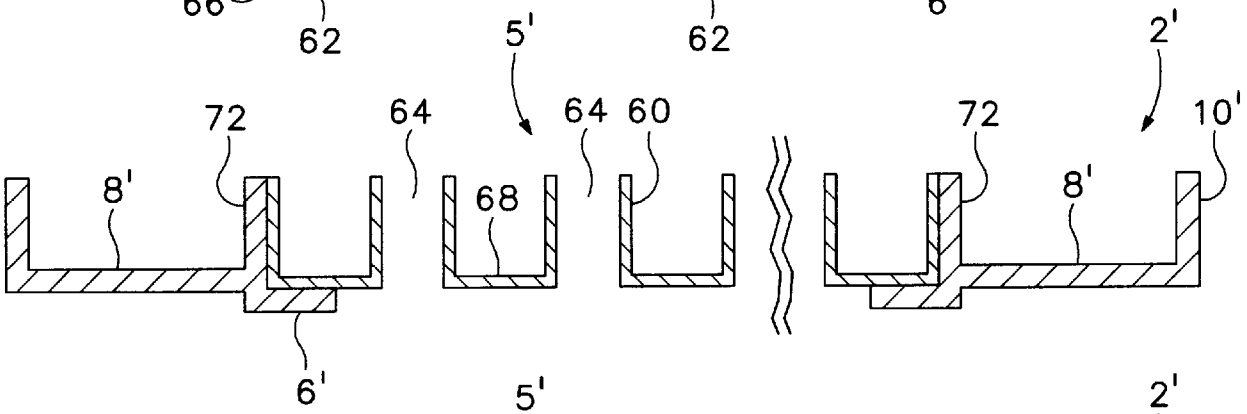
FIG. 13 is an enlarged cross sectional view of the assembled alternate embodiment of the forced air vent register taken along line 113—113 of FIG. 11.

Referring to FIG. 13, an enlarged cross sectional view of the assembled alternate embodiment of the forced air vent register taken in the direction of line B—B of FIG. 11, the spaced relationship between adjacent channels 60 is illustrated. Louver spaces 64 are substantially equal between the channels 60.

Figure 14:
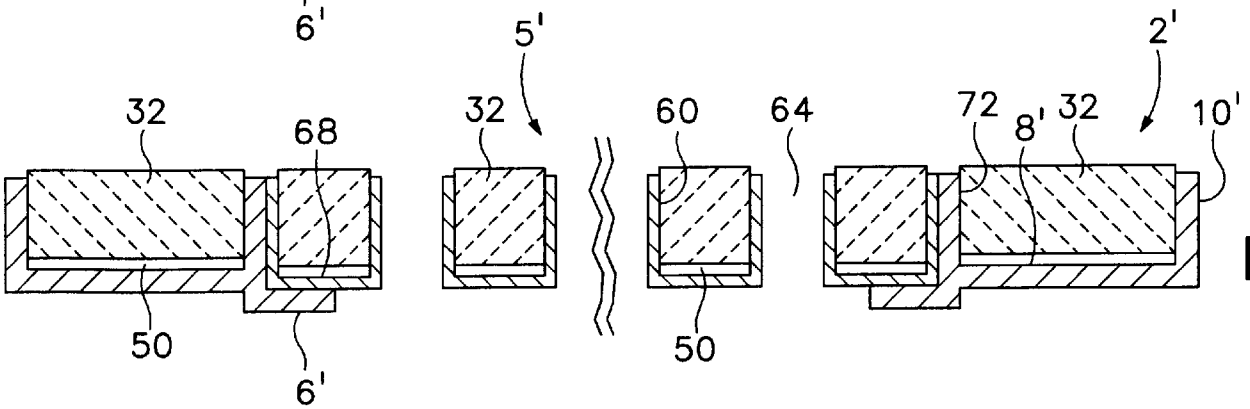
FIG. 14 is an enlarged cross sectional view of the assembled alternate embodiment of the forced air vent register as in FIG. 13 with tile installed.

Referring to FIG. 14, an enlarged cross sectional view of the assembled alternate embodiment of the forced air vent register as in FIG. 13 with tile installed, the placement of tile pieces 32 within border 2' and louver cradle 5' may be observed. A suitable adhesive may be applied to border support bottom 8' and channel bottom 68 to retain tile pieces 32 therein.

Referring to FIGS. 11–14 together, in the alternate embodiment louver cradle 5' is fitted into opening 14' by resting channel bottoms 68 upon cradle flange 6'. When louver cradle 5' is installed into border support 2', notches 66 protrude beyond flange 6' to prevent any relative movement between the louver cradle 5' and border support 2'. Channel height 72 and border support height 70 are substantially similar and approximate the height that the combined flooring and adhesive rise above the subfloor. This height will vary to permit the register to accommodate flooring of standard dimensions such as ⅜ inch, ½ inch, ¾ inch, etc. When installed, register 22 is flush with the top surface of the surrounding flooring so as to blend in aesthetically with the environment and prevent bumping by footwear, furniture, etc. Because louver cradle 5' merely rests on flange 6', louver cradle 5' is easily removable from border support 2' for cleaning or retrieval of objects. Since preferably, both border support 2' and louver cradle 5' are made of steel, aluminum, brass or other suitably rigid material, a considerable weight may be placed on louver cradle 5' without fear of deformation or damage.

Numerous further alternate embodiments are also available. In one such alternate embodiment, the two separate pieces that make up the air vent register, the border support and the louver cradle, are joined together to form a single register unit, allowing for two types of installation. In the first type of installation, this single register unit is permanently affixed to subfloor 24 allowing grout 34 to be installed between the border support exterior side and the adjacent tiles 30. In the second installation method, grout 34 is not allowed to adhere to the border support exterior side and the register unit is maintained in place by its own weight and is thus removable for access.

The dimensions of registers according to other alternate embodiments may vary. For example, channel heights 38 and 72 and border support height 40 may be substantially similar to each other but with a lesser dimension height than that of the flooring affixed to the subfloor surrounding register 22. In this way, the only parts of the register visible are the cut tile pieces. Exterior side walls 10, interior side walls 12 and channels 16 would he hidden from view in such an embodiment.

Preferably, the register according to the invention is used with ceramic tiled floors, but numerous other flooring materials work equally as well including wood, marble, granite, rubber, carpet, laminate flooring, linoleum, vinyl, for example.

While the preferred embodiment employs a louver cradle with parallel channels spaced equidistantly, other patterns are possible for aesthetic effect. Such patterns can employ different angles for the channels, different geometric shapes for the border support, varying channel thickness, or different louver spacing. The air adjustment plate is suitably profiled correspondingly.

Although the embodiments disclosed refer to a forced air vent register for flooring, this invention can also be used for wall or ceiling registers where wood, tile, sheetrock or plaster have been applied to the wall or ceiling. Due to the numerous shapes and sizes of forced air vents, the actual dimensions of these registers vary.

Accordingly, a forced air vent register is provided for that receives pieces of flooring such that, when installed, resides flush with the top surface of the surrounding floor thereby reducing the visual obtrusiveness of the grille and increasing the aesthetic appeal of the surrounding floor. A sliding adjustable air plate allows for the adjustment of the flow of air through the register.

While plural embodiments of the present invention have been shown and described, it will be apparent to those skilled in the art that many changes and modifications may be made without departing from the invention in its broader aspects. The appended claims are therefore intended to cover all such changes and modifications as fall within the true spirit and scope of the invention.

We claim:

1. A forced air vent register comprising:

a louver cradle; and a border support, wherein said border support defines an enclosed space and supports said louver cradle within said enclosed space, and wherein at least one of said lover cradle and said border support have flooring receiving portions defined therein, for supporting flooring material therein.

2. The forced air vent register according to claim 1 wherein said border support further comprises a top face and a bottom face, and said louver cradle further comprises a top face and a bottom face, and wherein said top faces reside coplanar and flush.

3. The forced air vent register according to claim 1 wherein said border support further comprises substantially U-shaped channels joined so as to form a planar, enclosed shape.

4. The forced air vent register according to claim 1 wherein said border support further comprises at least one flange that projects normally toward said enclosed space and supports said louver cradle.

5. The forced air vent register according to claim 3 wherein said planar, enclosed shape is quadrilateral in configuration.

6. The forced air vent register according to claim 1 wherein said louver cradle flooring receiving portion comprises:

a plurality of channels held in spaced relationship with spaces defined between adjacent ones of said channels.

7. The forced air vent register according to claim 1 wherein said louver cradle and said border support are fabricated from a substantially rigid metal, polymer or composite material.

8. The forced air vent register according to claim 1 further comprising an air flow adjusting device.

9. The forced air vent register according to claim 6, further comprising an air flow adjusting device, wherein said air flow adjusting device comprises a plate that slidingly resides adjacent a face of said louver cradle, said plate having slit openings defined therein that correspond to said spaces defined between adjacent channels.

10. The forced air vent register according to claim 8 wherein said air flow adjusting device further comprises an adjustment member, wherein said air flow adjusting device can be adjusted by manipulation of said adjustment member.

11. The forced air vent register according to claim 1, further comprising flooring affixed within said flooring receiving portions.

12. The forced air vent register according to claim 1 further comprising flooring affixed within said flooring receiving portions, wherein said flooring material is selected from the group consisting of ceramic tile, marble tile, granite tile, stone, wood flooring, or laminate flooring.

13. A forced air vent register comprising:

a louver cradle; and a border support, wherein said border support defines an enclosed space and supports said louver cradle within said enclosed space, wherein said louver cradle further comprises a plurality of substantially H-shaped channels held in spaced relationship by connection with at least one beam wherein there are spaces defined between adjacent ones of said H-shaped channels, and further comprising flooring affixed within said border support and within said H-shaped channels of said louver cradle.

14. A forced air vent register according to claim 6 wherein adjacent said channels are oriented with their longitudinal axes substantially parallel and substantially equally spaced.

15. A forced air vent grille comprising:

a border support forming a substantially enclosed space;

a louver cradle having a plurality of channels having their longitudinal axes held in a substantially parallel spaced relationship with respect to one another; and a flooring material, wherein said louver cradle resides substantially coplanar with said border support and within said enclosed space defined by said border support, and wherein said flooring material is positioned within at least ones of said border support and said channels.

16. The forced air vent grille according to claim 15 wherein said flooring material is selected from the group consisting of ceramic tile, marble tile, granite tile, stone, wood flooring, or laminate flooring.

17. A method of matching a floor register to adjacent flooring material comprising the steps of:

installing a border support around a forced air duct opening;

installing first flooring pieces in said border support;

installing second flooring pieces in a louver cradle; and installing said louver cradle in said border support.

18. The method according to claim 17, wherein said louver cradle comprises a plurality of H-shaped channels held in substantially spaced parallel relationship.

* * * * *